US006222491B1

(12) United States Patent
Blom

(10) Patent No.: US 6,222,491 B1
(45) Date of Patent: Apr. 24, 2001

(54) ANTENNA ASSEMBLY

(75) Inventor: Carl Gustaf Blom, Lysekil (SE)

(73) Assignee: Moteco AB (SE)

( * ) Notice: Subject to any disclaimer, the term of this patent is extended or adjusted under 35 U.S.C. 154(b) by 0 days.

(21) Appl. No.: 09/174,680

(22) Filed: Oct. 19, 1998

Related U.S. Application Data

(63) Continuation of application No. PCT/SE97/00700, filed on Apr. 25, 1997.

(51) Int. Cl.[7] ..... H01Q 1/24
(52) U.S. Cl. ..... 343/702; 343/715; 343/749
(58) Field of Search ..... 343/702, 713, 343/715, 745, 749, 700 MS, 829, 846, 725; 333/219, 219.1; H01Q 9/08, 9/10, 1/24, 1/32

(56) References Cited

U.S. PATENT DOCUMENTS

| | | | | |
|---|---|---|---|---|
| 4,365,221 | * | 12/1982 | Vizmuller | 333/202 |
| 5,179,074 | * | 1/1993 | Fiedzisuzko et al. | 505/1 |
| 5,471,222 | * | 11/1995 | Du | 343/713 |
| 5,898,408 | * | 4/1999 | Du | 343/715 |

* cited by examiner

*Primary Examiner*—Tho Phan
(74) *Attorney, Agent, or Firm*—Rader, Fishman, Grauer & McGarry

(57) ABSTRACT

The disclosure relates to an antenna device for radio communications apparatus operating in the frequency range of 800–3000 MHz and including a radiator. A dielectric resonator is connected to the supply line of the antenna device, the resonator being galvanically discrete from the radiator but being operative to supply it.

28 Claims, 1 Drawing Sheet

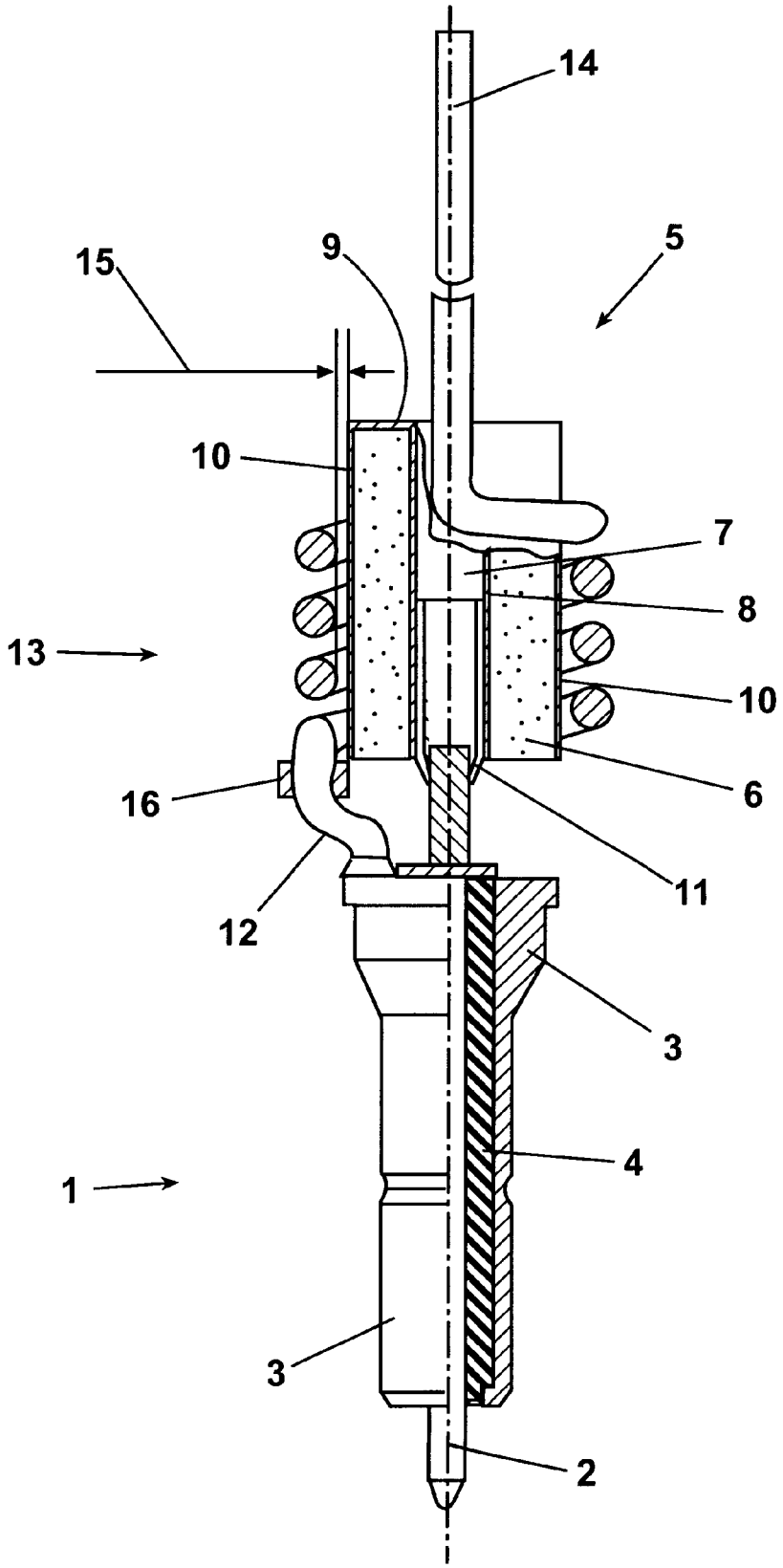
14
5
15
9
10
7
8
13
10
6
16
11
12
3
4
1
3
2

ANTENNA ASSEMBLY

RELATED APPLICATIONS

This application is a continuation of International Application No. PCT/SE97/00700, filed Apr. 25, 1997, and claims the benefit of Swedish Application No. 9601737-1, filed May 6, 1996.

BACKGROUND OF THE INVENTION

1. Field of the Invention

The present invention relates to an antenna device for a radio communications apparatus operating in the frequency range of 800–3000 MHz and including a radiator.

2. Related Art

On small portable radio communications apparatus, so-called mobile telephones, use has previously been made of a plurality of different antenna types, including rod antennas of the quarter wave or half wave type, helix antennas, etc. One common denominator for all of these prior art designs and constructions is that attempts have been made to keep the physical dimensions of the antenna as small as possible, the degree of efficiency as high as possible and the band width as large as possible. Certain antenna types have proved to be successful in one or two of these respects, but no truly optimum design and construction has yet been developed.

In particular in such situations where transmission and reception take place at great distances in terms of frequency, it is important that the antenna is of the wide band type.

SUMMARY OF THE INVENTION

The present invention has for its object to realize an antenna of the type disclosed by way of introduction which obviates the drawbacks inherent in prior art models. In particular, the present invention has for its object to realize an antenna device which has a good band width, which has small physical dimensions and which is insensitive to changes in the substrate plane. Furthermore, the present invention has for its object to realize an antenna device which is simple and economical in manufacture and which displays a high level of mechanical strength.

The objects forming the basis of the present invention will be attained if the antenna disclosed by way of introduction is characterized in that there is connected, to the supply line of the antenna, a dielectric resonator which is galvanically discrete from the radiator but which is disposed to supply it.

Further advantages will be attained if the antenna device is moreover characterized in that the radiator is a rod radiator which is connected in its one end to a coil, that the coil surrounds at least a part of the dielectric resonator and that the end of the coil facing away from the rod radiator is connected to ground.

These characterizing features will realize an antenna which satisfies the objects established in the present invention. Other objects, features, and advantages of the invention will be apparent from the ensuing description in conjunction with the accompanying drawings.

BRIEF DESCRIPTION OF THE DRAWINGS

In the drawings:

The present invention will now be described in greater detail hereinbelow, with particular reference to the accompanying Drawing which shows a vertical part cross section through an antenna device designed according to the invention.

DETAILED DESCRIPTION

There is a proliferation on the market of different so-called dielectric resonators which, for instance, are employed as active elements in wide band filters. One supplier of such resonators is the Japanese company Murata.

In principle, such a dielectric resonator is constructed as a hollow body which may possibly be cylindrical and which has a through channel provided with a thin metal layer extending out on one end surface of the resonator in order also to extend to the circumferential surface of the resonator. Otherwise, the material in the resonator is a ceramic substance with high dielectric constant, of the order of magnitude of between 40 and 200, but preferably between 80 and 100, The dielectric resonator which is employed in the device according to the present invention has been given reference numeral 5 in its entirety and encompasses a cylindrical body of insulating, preferably ceramic material of high dielectric constant, preferably of the order of magnitude of between 80 and 100, The higher the dielectric constant, the smaller will be the physical dimensions of the resonator at the same resonance frequency, while a high dielectric constant entails a slightly poorer degree of efficiency and possibly also a slightly reduced band width. Values as high as 200 may possibly be employed.

The antenna device has a connection terminal 1 with a metallic center conductor 2, a metallic outer sleeve 3 and an insulation 4 in between. The center conductor 2 is galvanically connected to the resonator 5.

The resonator 5 has a central channel 7 which is coated with a thin metal layer, a metalisation 8. The metal layer 8 of the channel extends up on the upper end surface of the resonator in the Drawing figure and, thereby, one end metal layer 9 covers the entire end surface. Further, the resonator also has a metal layer 10 on its outer surface or circumferential surface. The metal layers 8, 9 and 10 are galvanically interconnected.

The upper end of the center conductor 2 of the connection terminal 1 is, as was intimated above, galvanically connected to the metal layer 8 of the channel 7 via a contact device 11, for example in the form of a sock soldered in the metal layer 8 and the conductor 2.

The outer sleeve 3 of the connection terminal 1 is, via a short connection lead 12, in galvanic communication with a coil 13 which, in its upper end, merges in a radiator in the form of a rod 14. The connection lead 12, the coil 13 and the radiator 14 may be made of an enamelled copper wire or an insulated metal wire of other, preferably durable metal alloy. Between the inner surface of the coil 13 and the outside of the outer metal layer 10 of the resonator 5, there is a small gap 15. There is thus disposed between the inside of the coil and the outside of the resonator a non-conductive dielectric which may consist of air, but which May also consist of an insulating layer of plastic or rubber-like type.

It is entirely possible to realize a dielectric resonator for approx. 1 GHz in the form of a cylinder of a length of 9 mm and a diameter of 3.5 mm. In a prototype antenna, use has been made of 0.88 mm wire diameter in both the coil 13 and the radiator 14, in which event the coil had approx. 3 turns and the rod length was approx. 45 mm. The antenna is set to a central frequency of 900 MHz and operates as a quarter wave radiator.

The dielectric resonator has a well-defined natural resonance frequency which manifests itself as a very narrow and high "peak" in scan transmission measurement. The resonance frequency is selected to be at a level just above the desired upper operating frequency for the antenna. The inductive portion of the antenna, i.e. the coil 13, is dc-grounded, which will have as a consequence that the resonator is gradually coupled over to the coil, either capacitatively or inductively, but preferably both. By optimization of the number of turns and/or pitch in the coil, as well as the distance between the coil and the resonator, the transfer between the resonator and the coil may be made adequate. At the same time as the transfer is optimized, an increase in the band width is also ensured. A band width of as much as 15 percent of the central frequency of the antenna device is possible.

An antenna of this type is also less sensitive to variations in the ground substrate, whereby such chassis currents as may be induced in a resonant chassis can be reduced. This property may further be improved if the end of the coil 13 facing away from the radiator 14 is provided with a body 16, possibly a hollow cylinder, of absorbent ferrite.

In the foregoing the antenna has been described as a rod radiator of quarter wave length. However, the present invention may also be applied to other types of radiators, of both the quarter wave and half wave type. For example, helix antennae may be selected. The present invention may be modified without departing from the spirit and scope of the appended claims.

While the invention has been specifically described in connection with certain specific embodiments thereof, it is to be understood that this is by way of illustration and not of limitation, and the scope of the appended claims should be construed as broadly as the prior art will permit.

What is claimed is:

1. An antenna device for a radio communications apparatus operating in the frequency range of 800–3000 MHz comprising a radiator, a supply line, and a dielectric resonator, wherein the dielectric resonator is galvanically connected to the supply line and galvanically discrete from the radiator but operative to supply the radiator; and wherein the radiator is a rod radiator which, in its one end, is connected to a coil;

the coil surrounding at least a part of the dielectric resonator; and the end of the coil facing away from the rod radiator being connected to ground.

2. The antenna device as claimed in claim 1, wherein there is disposed, about the end portion of the coil connected to ground or its connection line to ground, an annular body of ferrite.

3. The antenna device as claimed in claim 2, wherein the dielectric resonator is in the form of a dielectric body with a through channel, the defining surface of the channel, the one end of the body and its outer surface having a metal layer; and that the supply line is galvanically connected to the metal layer of the channel while the metal layer of the outer surface is located a slight distance from adjacent surfaces of the coil.

4. The antenna device as claimed in claim 1, wherein the dielectric resonator is in the form of a dielectric body with a through channel, the defining surface of the channel, the one end of the body and its outer surface having a metal layer; and that the supply line is galvanically connected to the metal layer of the channel while the metal layer of the outer surface is located a slight distance from adjacent surfaces of the coil.

5. The antenna device as claimed in claim 4, wherein the resonance frequency of the dielectric resonator is selected to be at a value immediately above the desired upper operating frequency of the antenna device.

6. The antenna device as claimed in claim 1, wherein the dielectric resonator is disposed to supply the radiator both capacitatively and inductively.

7. The antenna device as claimed in claim 6, wherein there is disposed, about the end portion of the coil connected to ground or its connection line to ground, an annular body of ferrite.

8. The antenna device as claimed in claim 7, wherein the dielectric resonator is in the form of a dielectric body with a through channel, the defining surface of the channel, the one end of the body and its outer surface having a metal layer; and that the supply line is galvanically connected to the metal layer of the channel while the metal layer of the outer surface is located a slight distance from adjacent surfaces of the coil.

9. The antenna device as claimed in claim 6, wherein the dielectric resonator is in the form of a dielectric body with a through channel, the defining surface of the channel, the one end of the body and its outer surface having a metal layer; and that the supply line is galvanically connected to the metal layer of the channel while the metal layer of the outer surface is located a slight distance from adjacent surfaces of the coil.

10. The antenna device as claimed in claim 9, wherein the resonance frequency of the dielectric resonator is selected to be at a value immediately above the desired upper operating frequency of the antenna device.

11. The antenna device as claimed in claim 1, wherein the resonance frequency of the dielectric resonator is selected to be at a value immediately above the desired upper operating frequency of the antenna device.

12. An antenna device for a radio communications apparatus operating in the frequency range of 800–3000 MHz comprising:

a radiator comprising a rod radiator which, in its one end, is connected to a coil;

a supply line;

a dielectric resonator discrete from the radiator but is operative to supply the radiator one of capacitatively and inductively; and wherein the coil surrounds at least a part of the dielectric resonator; and the end of the coil facing away from the rod radiator is connected to ground.

13. The antenna device as claimed in claim 12, wherein there is disposed, about the end portion of the coil connected to ground or its connection line to ground, an annular body of ferrite.

14. The antenna device as claimed in claim 13, wherein the dielectric resonator is in the form of a dielectric body with a through channel, the defining surface of the channel, the one end of the body and its outer surface having a metal layer; and that the supply line is galvanically connected to the metal layer of the channel while the metal layer of the outer surface is located a slight distance from adjacent surfaces of the coil.

15. The antenna device as claimed in claim 12, wherein the dielectric resonator is in the form of a dielectric body with a through channel, the defining surface of the channel, the one end of the body and its outer surface having a metal layer; and that the supply line is galvanically connected to the metal layer of the channel while the metal layer of the outer surface is located a slight distance from adjacent surfaces of the coil.

16. The antenna device as claimed in claim 15, wherein the resonance frequency of the dielectric resonator is selected to be at a value immediately above the desired upper operating frequency of the antenna device.

17. In an antenna device for a radio communications apparatus operating in the frequency range of 800–3000 MHz comprising a radiator and a supply line electrically coupled to the radiator, the improvement comprising:

a dielectric resonator galvanically discrete from the radiator but operative to supply the radiator, a coil surrounding at least part of the dielectric resonator, and the radiator comprises a rod radiator, wherein one end of the rod radiator is connected to the coil and an end of the coil facing away from the rod radiator is connected to ground.

18. The antenna device as claimed in claim 17, wherein there is disposed, about the end portion of the coil connected to ground or its connection line to ground, an annular body of ferrite.

19. The antenna device as claimed in claim 18, wherein the dielectric resonator is in the form of a dielectric body with a through channel, the defining surface of the channel, the one end of the body and its outer surface having a metal layer; and that the supply line is galvanically connected to the metal layer of the channel while the metal layer of the outer surface is located a slight distance from adjacent surfaces of the coil.

20. The antenna device as claimed in claim 19, wherein the resonance frequency of the dielectric resonator is selected to be at a value immediately above the desired upper operating frequency of the antenna device.

21. The antenna device as claimed in claim 17, wherein the dielectric resonator is disposed to supply the radiator one of capacitatively and inductively.

22. In an antenna device for a radio communications apparatus operating in the frequency range of 800–3000 MHz and comprising a radiator and a supply line, the improvement comprising:

a dielectric resonator galvanically discrete from the radiator but operative to supply the radiator, a coil surrounding at least part of the dielectric resonator with an end of the coil fading away from the radiator being connected to ground, and the dielectric resonator comprises a dielectric body with a through channel, the defining surface of the through channel, the one end of the body and its outer surface all having a metal layer, and the supply line is galvanically connected to the metal layer of the channel while the metal layer of the outer surface is located a slight distance from adjacent surfaces of the coil.

23. The antenna device as claimed in claim 22, wherein there is disposed, about the end portion of the coil connected to ground or its connection line to ground, an annular body of ferrite.

24. The antenna device as claimed in claim 23, wherein the resonance frequency of the dielectric resonator is selected to be at a value immediately above the desired upper operating frequency of the antenna device.

25. The antenna device as claimed in claim 22, wherein the dielectric resonator is disposed to supply the radiator one of capacitatively and inductively.

26. An antenna device for a radio communications apparatus operating in the frequency range of 800–3000 MHz and comprising a radiator and a supply line, the improvement comprising:

a dielectric resonator galvanically discrete from the radiator but operative to supply the radiator;

the resonance frequency of the dielectric resonator is selected to be at a value immediately above the upper operating frequency of the antenna device; and the radiator is a rod radiator which, in its one end, is connected to a coil;

wherein the coil surrounds at least a part of the dielectric resonator; and the end of the coil facing away from the rod radiator is connected to ground.

27. The antenna device as claimed in claim 26, wherein there is disposed, about the end portion of the coil connected to ground or its connection line to ground, an annular body of ferrite.

28. The antenna device as claimed in claim 27, wherein the dielectric resonator is in the form of a dielectric body with a through channel, the defining surface of the channel, the one end of the body and its outer surface having a metal layer; and that the supply line is galvanically connected to the metal layer of the channel while the metal layer of the outer surface is located a slight distance from adjacent surfaces of the coil.

* * * * *

UNITED STATES PATENT AND TRADEMARK OFFICE

CERTIFICATE OF CORRECTION

PATENT NO. : 6,222,491 B1
DATED : April 24, 2001
INVENTOR(S) : Carl Gustaf Blom

It is certified that error appears in the above-identified patent and that said Letters Patent is hereby corrected as shown below:

Column 5, claim 22,
Line 41, "fading" should be -- facing --.

Signed and Sealed this

Eighth Day of January, 2002

*Attest:*

*Attesting Officer*

JAMES E. ROGAN
*Director of the United States Patent and Trademark Office*